United States Patent [19]

Thuringer

[11] 4,202,569

[45] May 13, 1980

[54] CRAFT BOARD

[76] Inventor: Frieda P. Thuringer, 2755 Hillcrest Dr., Wellsville, N.Y. 14895

[21] Appl. No.: 889,280

[22] Filed: Mar. 23, 1978

[51] Int. Cl.[2] ..... D04G 3/02

[52] U.S. Cl. ..... 289/18.1; 28/149; 38/102.91; 206/564; 223/108

[58] Field of Search ..... 223/108, 106, 107; 112/79 R, 80; 206/564, 565, 574; 28/149, 151, 152; 289/17, 18; 38/102, 102.1, 102.91

[56] References Cited

U.S. PATENT DOCUMENTS

| | | | |
|---|---|---|---|
| 2,230,394 | 2/1941 | Young | 206/564 X |
| 2,261,943 | 11/1941 | Rogers | 223/106 |
| 2,263,916 | 11/1941 | Boyle | 28/149 |
| 2,547,762 | 4/1951 | Krug | 206/564 |
| 2,695,712 | 11/1954 | Kolander | 206/564 X |
| 2,802,254 | 8/1957 | Valva | 28/149 |
| 3,621,541 | 11/1971 | Watkins | 28/149 |

FOREIGN PATENT DOCUMENTS

| | | | |
|---|---|---|---|
| 2204195 | 5/1974 | France | 289/18 |

OTHER PUBLICATIONS

Yankee Magazine, p. 202, Mar. 1979, Pub. by Yankee, Inc., Dubling, N.H.

*Primary Examiner*—Louis Rimrodt

*Attorney, Agent, or Firm*—Dolgorukov & Dolgorukov

[57] ABSTRACT

The specification discloses a Craft Board which has many different uses in the handicraft field.

The board provides hook means to attach various different handicraft works to the Craft Board, therefore eliminating the use of bulky holding frames or the sticking of pins into various objects and the like, to secure the handicraft being worked on to the board.

Also disclosed are means to hold and store the various materials which can be used during the craft work.

6 Claims, 5 Drawing Figures

CRAFT BOARD

The present invention relates to work holding devices of the type which may be used to hold backings for rug hooking, crewel, embroidery, or the like, and more particularly to a novel improved Craft Board used for these purposes.

A search of the prior art revealed that the following U.S. patents were generally related to the subject matter of the present invention:

U.S. Pat. No. 2,136,552—J. A. LePage;
U.S. Pat. No. 2,159,265—A. J. Gash;
U.S. Pat. No. 2,199,515—J. A. Woods;
U.S. Pat. No. 2,547,250—V. C. Bennett;
U.S. Pat. No. 2,691,203—H. W. Wilder.

As being one who has enjoyed the handicrafts of rug hooking, crewel, embroidery and many other types of needlework, I have encountered certain common problems which everyone who enjoys these hobbies has come across at one time or another. One of the most perplexing problems which I encountered was how to conveniently hold the backing materials for these crafts, one of the most common of these being the rug base for the hobby of latch hooking of rugs which consists of an open weave material having rectangular interstices between the woven strands thereof.

Since the hobby of rug hooking involves inserting short lengths of yarn into this rug base, one of the main problems is how to hold this rug base in a convenient position while working thereon to prevent the common problem of having to work on it in one's lap and having it continually fall on the floor.

Attendant to this problem is how to keep one's tools and materials in a convenient location while working on the rug base, as such rug base may be quite large at times, and takes up a considerable area.

After giving the problem much thought, it was decided that large bulky frames would have to be eliminated, and a small portable device of some sort would be necessary, with means to attach the rug base or other backing materials thereto in a convenient and inexpensive manner.

The use of hooks by which the work can be easily attached and unattached to the board eliminates the usual sticking of pins into a chair, sofa arms, table or any other fixed object which holds the craft work taut.

The present use of large bulky frames to hold the craft work meterial is also eliminated. The utility of these hooks (or any other securing means) is at once obvious since they can be used to hold any type of work taut from pillows to wall hanging rugs.

Accordingly, one of the objects of the present invention is to provide an improved Craft Board which has many uses within the field of the handicraft arts.

Another object of the present invention is to provide a means for attaching and unattaching the handicraft work which is being held taut during its construction.

Another object of the present invention is to provide a convenient means for storage of beads, sequins, yarn and any other materials being used during the handicraft operations.

A still further object of the present invention is to provide means for the temporary storage of the work in progress.

A still further object of the present invention is to provide a portable Craft Board which is very neat, compact and that can be conveniently taken anywhere as the need may arise.

Another object of the present invention is to provide a means for placing and storing of handicraft tools, such as scissors, latch hook, thread, needles, etc.

Another object of the present invention is to construct an economical integral one-piece Craft Board from various types of materials.

Further objects and advantages of this invention will be apparent from the following description and appended claims, reference being had to the accompanying drawings forming a part of the specification, wherein like reference characters designate corresponding parts in the several views.

It is to be understood that the invention is not limited in its application to the details of construction and arrangement of parts illustrated in the accompanying drawings, since the invention is capable of other embodiments and of being practiced or carried out in various ways within the scope of the claims. Also, it is to be understood that the phraseology and terminology employed herein is for the purpose of description, and not of limitation.

After trying many shapes and sizes of work-piece holders, I arrived at a rectangularly-shaped board, one modification of which has suction cups attached to the bottom thereof allowing the board to be fixed in practically any position to a table, workbench or the like. Attached to the board can be fastening means, such as alligator clips, spring clamps, cup hooks, or the like, with the preferred embodiment having several of these fastening means spaced linearly on an axis parallel to the front of the Craft Board.

Further work on my invention showed that I could provide for the inclusion of the means to store the materials being used during the craft work, and provide a convenient and useful storage place for beads, sequins, yarn and other materials that are being used, as well as provide a Craft Board having great portability, which makes it extremely easy to use, and also provides for the storage of the material and tools being used in the craft work.

My work also showed that it would be desirable to make a Craft Board which could be constructed of many different materials, such as wood, metal, plastic, fiberglas or the like, which could allow either a one-piece integral construction, or a multiple-piece construction which, in any event, would be relatively simple and inexpensive to manufacture.

Figure 1:
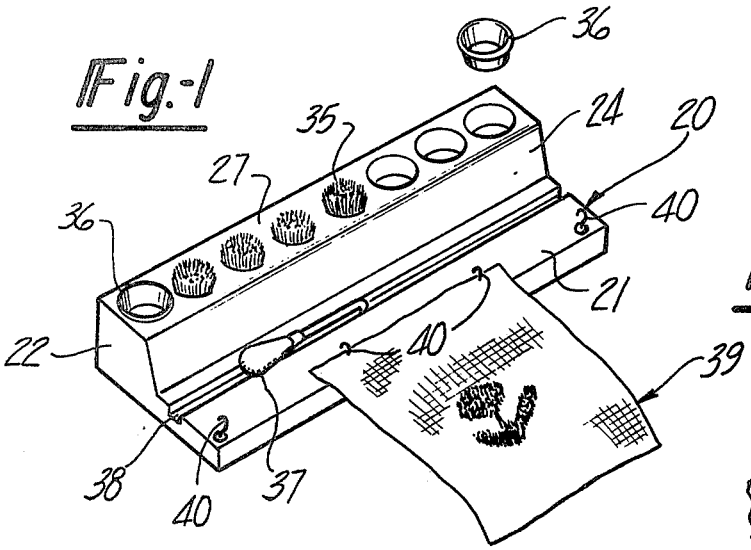
FIG. 1 is a perspective view of a craft board embodying my invention.
Figure 2A:
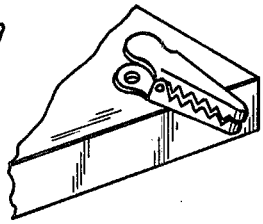
FIG. 2A is a fragmentary view showing a portion of the construction shown in FIG. 2, wherein an alligator clip has been substituted as the holding means in place of the cup hook.
Figure 2:
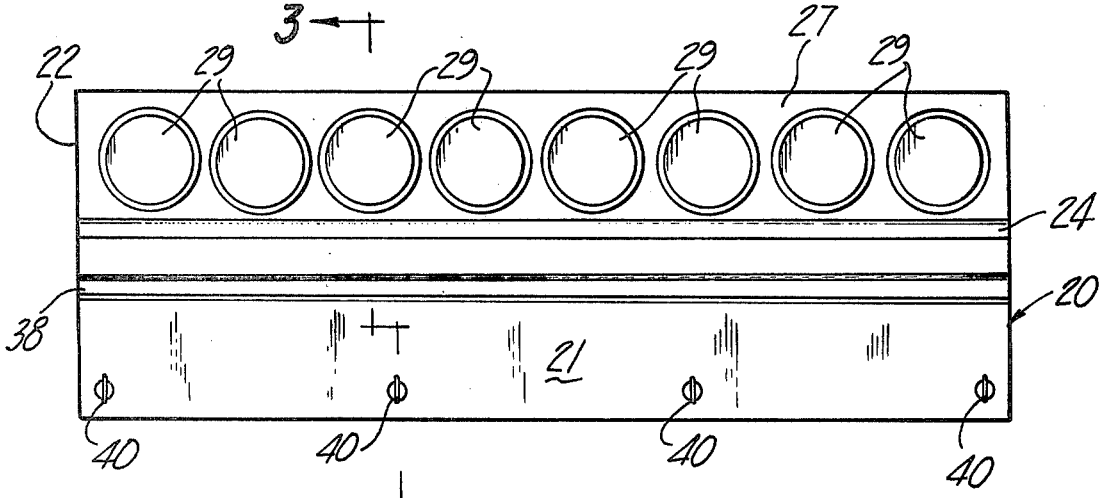
FIG. 2 is a plan view of a construction embodying the present invention.
Figure 3:
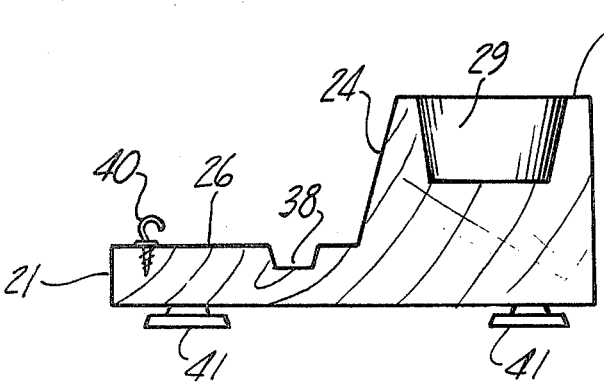
FIG. 3 is a sectional view taken in the direction of the arrows along the section line 3—3 of FIG. 2.
Figure 4:
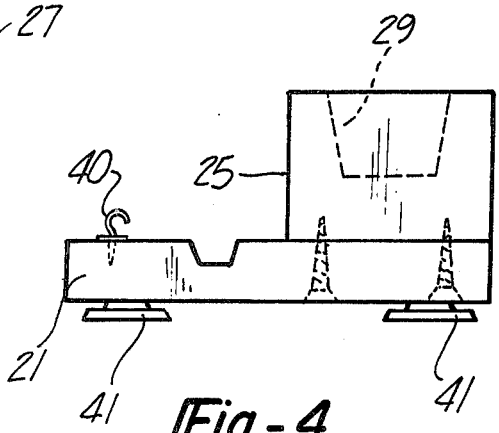
FIG. 4 is an end view of a construction embodying the present invention as it may be made using a two-piece construction.

There is shown in FIG. 1 a perspective view of the preferred embodiment of my invention. The craft board generally designated by the numeral 20 comprises a horizontal support member 21 having depending therefrom a vertical storage member 22 which may be formed integrally with the horizontal member, as shown in FIG. 1 or 3, or it may be a separate member as shown in FIG. 4, fastened to the horizontal support member 21 by suitable fastening means, such as nails, screws or the like, designated by the numeral 23. The forward portion of the vertical storage member may be tapered as indicated by the numeral 24 in FIG. 3, or may be vertical as indicated by the numeral 25 in FIG. 4. While the manufacturing process to be used in the manufacture of my invention will in some cases determine whether the taper 24 is present, such taper is preferred, as it does give a greater effective work area immediately adjacent the top 26 of the horizontal support member 21. Provided in the top surface 27 of the vertical support member 22 are a plurality of recesses 29. Some or all of the recesses may be used to hold short bundles of yarn designated by the numeral 35.

It should be understood that although the recesses are shown of circular cross section, and of moderate depth, they could be of any cross section and depth depending upon the use which the hobbiest desires to put my craft board to. If desired, instead of placing bundles of yarn 35 in all of the recesses 29, one or more plastic cups 36 of a cross section complementary to that of the recess 29 may be placed therein. Such cups are particularly useful when the Craft Board is used for holding work using sequins and the like, and these can be placed in the cups 36. In this instance, the depth of the cup is preferably only about one inch so that the sequins may easily be removed therefrom.

For convenience in holding work tools, such as that designated by the numeral 37, a recess 38 is provided in the horizontal support member 21 parallel to the front thereof, although it should be understood that this could be made in any practicable cross section and direction that it is desired.

The rug backing or other craft material generally designated by the numeral 39 is attached to the Craft Board simply by placing it over a plurality of fastening means provided on the top surface 21 of the Craft Board. In the preferred embodiment, these fastening means take the form of a plurality of linearly spaced cup hooks 40, mounted in a line parallel to the front edge of the craft board. It can be seen that it is well within the scope of the present invention to provide that the fastening means be other than cup hooks 40, such as alligator clips 42, spring clamps 43, and the like, and that they be mounted in other types of spaced relationships besides that of being linearly spaced, depending upon the particular operation to be performed using the craft board.

While not necessary, since my invention can be held in one's lap while it is being used, in certain instances I have found that it is convenient to have my craft board sitting on a table while performing the operations of rug hooking and the like, and in such cases it is desirable that some attaching means be provided to hold the board in place on the table. After some experimentation, I have determined that the common rubber suction cup mounted proximate each corner of the board serves the purpose of holding the board to the table very well. Thus, there are shown a plurality of such suction cup devices identified with the numeral 41.

Therefore, by abandoning the use of heavy frame means for holding rug backings and the like, and going to the design of a portable device, I have provided a new and novel craft board enabling the hobbiest to perform the operations of rug hooking, embroidering, crewel, needlepoint and the like in a new and efficient manner.

I claim:

1. A craft board including a horizontal support member and a tapered vertical storage member depending therefrom, a plurality of fastening means fixedly connected to the top of the horizontal support member in a spaced relationship, and means to store the work materials within the vertical storage member, wherein the horizontal support member has a longitudinal recess provided therein between the front of said craft board and said vertical storage member, and said vertical storage member has recesses within the top thereof of a circular cross section, and further including attaching means in the form of suction cups secured to the bottom of said craft board for the purpose of securing the craft board to a substantially flat surface during the craft work.

2. The device defined in claim 1, wherein said fastening means include cup hook means connected to the top of said horizontal support member in a linearly spaced relationship.

3. The device defined in claim 1, wherein a plastic cup is inserted into at least one of said recesses within said vertical storage member.

4. The device defined in claim 1, wherein said horizontal support member and said vertical storage member are of integral one-piece construction.

5. The device defined in claim 1, wherein the horizontal support member and the vertical storage member are of separate construction forming a two-piece craft board.

6. The device defined in claim 1, wherein said fastening means used to secure the craft work are alligator clips connected to the top of the horizontal support member.

* * * * *